United States Patent [19]

Russon et al.

[11] 4,436,007

[45] Mar. 13, 1984

[54] AUTOMATED FEED FOR A PUNCH PRESS AND METHOD OF USING SAME

[75] Inventors: Darrel L. Russon; Warren H. Wheeler, both of Seattle, Wash.

[73] Assignee: The Boeing Company, Seattle, Wash.

[21] Appl. No.: 248,153

[22] Filed: Mar. 30, 1981

[51] Int. Cl.[3] ..... B26D 1/40

[52] U.S. Cl. ..... 83/23; 83/63; 83/71; 83/208; 83/251; 83/281

[58] Field of Search ..... 271/14, 221, 222; 83/40, 61, 63, 66, 71, 98, 208–210, 251, 255, 281, 405, 417, 923, 23

[56] References Cited

U.S. PATENT DOCUMENTS

| | | | |
|---|---|---|---|
| 1,494,339 | 5/1924 | Clauberg | 271/222 |
| 1,916,378 | 7/1933 | Leland | 83/281 X |
| 2,265,617 | 12/1941 | Yates | 271/222 X |
| 3,466,958 | 9/1969 | Munson | 83/280 X |
| 3,568,554 | 3/1971 | Wiechec | 83/98 |
| 3,589,221 | 6/1971 | Deegan | 83/923 X |
| 3,599,969 | 8/1971 | West | 271/14 |
| 3,765,284 | 10/1973 | Maiorino | 83/281 X |
| 3,830,121 | 8/1974 | Makeev et al. | 83/281 X |
| 3,889,565 | 6/1975 | Vecchi | 83/923 X |
| 4,125,182 | 11/1978 | Karlowicz | 83/61 X |
| 4,162,641 | 7/1979 | Stubbings | 271/223 X |

*Primary Examiner*—James M. Meister

*Attorney, Agent, or Firm*—Morris A. Case; B. A. Donahue

[57] ABSTRACT

A stack of strips of feed stock are placed on an adjustable height table. The strips are positioned on the table by arms which align the stack to the centerline of punching dies in a punch press. A pneumatic actuated head uses vacuum cups to raise the end of the top strip and insert it into in-feed rolls. The drive means for the in-feed rolls also drive an encoder which signals roll movement as the rolls incrementally feed the stock into the punch press. Drive means for the feed stock switches to the out-feed rolls once the blanked out stock reaches those rolls, and when the end of the strip passes through the punch press, a control unit is signaled and a new strip is fed into the system.

11 Claims, 4 Drawing Figures

AUTOMATED FEED FOR A PUNCH PRESS AND METHOD OF USING SAME

BACKGROUND OF THE INVENTION

In operations where feed stock is automatically fed to a punch press the feed stock normally ues a coil of material. No provisions are found for automatically feeding consecutive strips of various widths and thicknesses as no provisions are found for automatically recognizing the beginning and ending of short strips of feed stock. It was found that automatic means could not only handle coils of feed stock but could also automatically use strips of feed stock.

SUMMARY OF THE INVENTION

An adjustable height stack table for feed stock has adjustable arms along each side to align varying widths of feed stock to a punch press. A pick-up head automatically raises the end of feed stock and inserts it into a set of feed rolls which advance a leading edge of the stock to a calibration position from which position the in-feed rolls automatically advance the feed stock into blanking position in the punch press then incrementally advance the stock after each punching operation. Once the blanked out scrap stock reaches a set of feed rolls, those rolls take over and incrementally feed the press. Encoders on the rolls, in conjunction with computer-operated controls, sequence the operation.

It is an object of this invention to automatically feed strips of feed stock.

DETAILED DESCRIPTION

Figure 1:
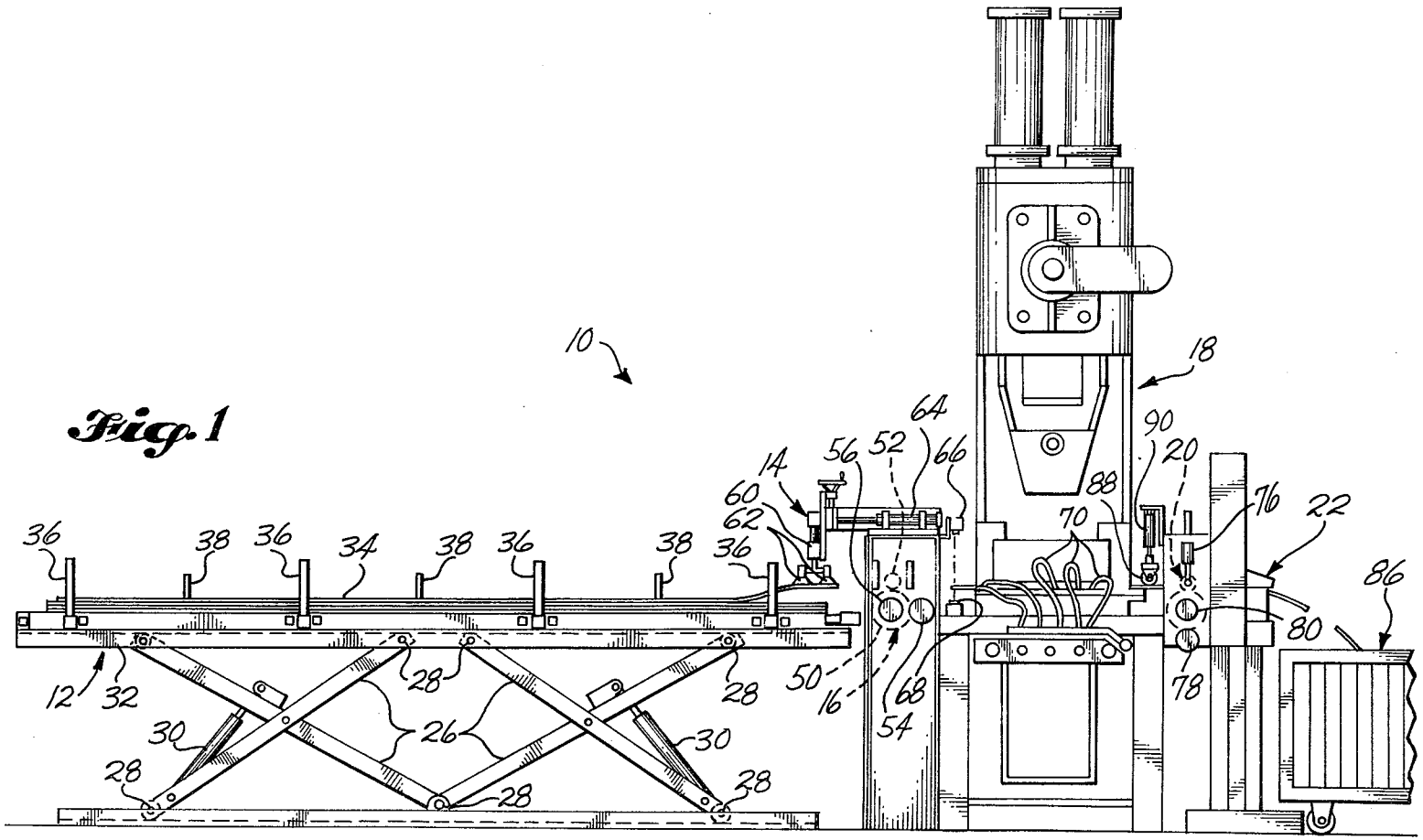
FIG. 1 shows a side elevational view of this invention.
Figure 2A:
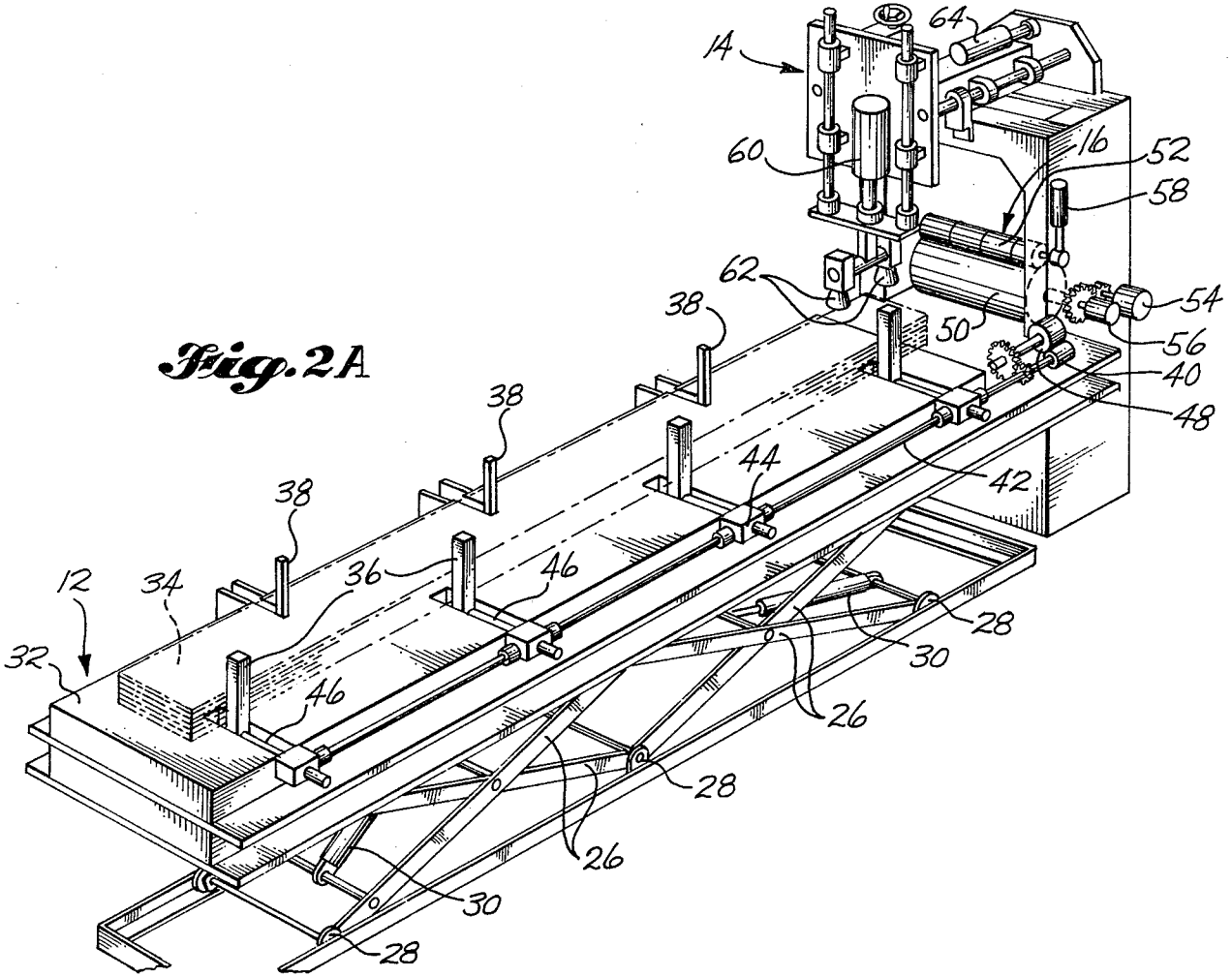
FIGS. 2A and 2B show perspective views of the invention of FIG. 1.
Figure 2B:
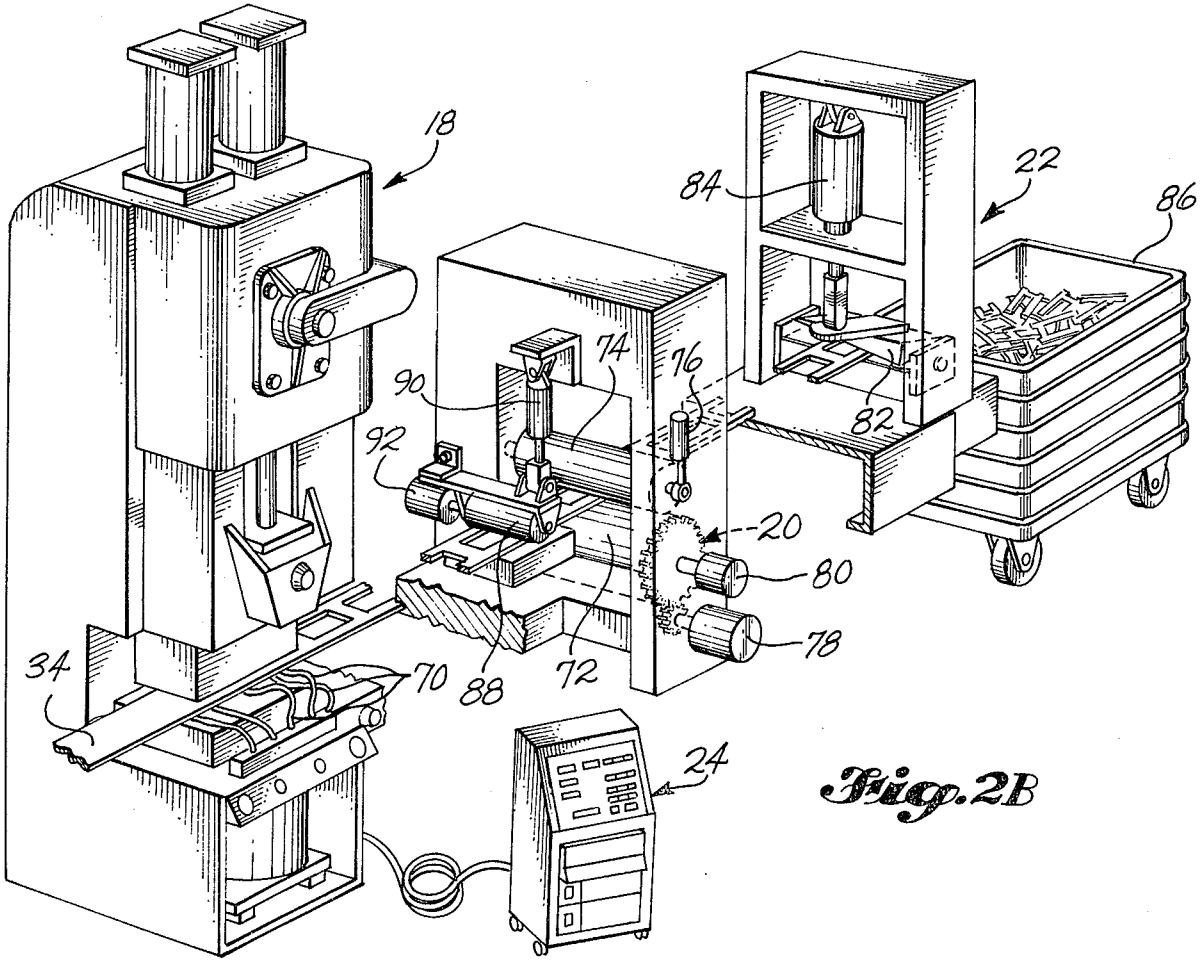

An automated system 10 for processing the blanking of metal calls for a stack table 12, a pick-up head 14, in-feed rolls 16, a punch press 18, out-feed rolls 20, a scrap chopper 22 and control unit 24.

The table 12 is preferably of the scissors-lift type to permit legs 26, which are each pivotally mounted at 28, to be acted upon by hydraulic cylinders 30 to raise and lower the table top 32. Strips of feed stock 34 are stacked on the table. This feed stock is aligned to the punch press 18 by a series of positioning arms 36 and back-stop arms 38. The positioning arms locate the stack so that the centerline of each strip is located on the centerline of the press and the rest of the feed system. The positioning arms are driven by a small d.c. servo motor 40 through a drive line 42 and right angle gear boxes 44. A drive line 46 extends off of each gear box and laterally moves the upright positioning arms. The positioning arms press against and define the side location of the feed stock. An encoder 48 is also driven by the d.c. motor and emits a signal to provide feed-back of positioning arm location. The back-stop arms define the opposite side of the feed stock strips. Those arms are simultaneously actuated by pneumatic cylinders that first exert considerable pressure to ensure the feed stock is pressed against the positioning arms, then the pneumatic pressure is reduced to assure alignment while permitting longitudinal movement of the feed stock 34.

These positioning and back-up arms ensure alignment of the feed stock, whether it be strips of stock as shown here or whether it be coils of feed stock.

The feed stock strips 34 are introduced one at a time into in-feed rolls 16. These rolls consist of a large driven roll 50 which is preferably covered with neoprene and a smaller clamping idler roll 52 which is preferably covered with polyethylene. The driven roll is actuated with a d.c. servo motor 54. An encoder 56 is coupled to the driven roll to provide roll position information as the roll rotates. The idler roll is raised and lowered by pneumatic cylinders 58.

A pick-up head 14 has a pneumatic cylinder 60 which moves a pair of vacuum cups 62 down against the leading edge of the top strip. A vacuum is initiated and the end of the strip raised. Cylinder 64 is actuated to move ahead with strip to insert the end of the stock strip into the in-feed rolls. The vacuum is turned off, releasing the feed stock, and the pick-up head returned to starting position. The in-feed rolls are then clamped together and the feed stock moved forward until the end of the feed strip interrupts an electric eye sensor consisting of a light source 66 located above the strip and just downstream from the in-feed rolls and a photo-detector 68 located below the strip. When the sensor is actuated it acts as a calibration position, sending a signal to the control unit 24 from which a computer sends a signal to the drive motor on the in-feed roll to advance the feed stock from the calibration position to a position for blanking in the punch press. Once the press is actuated and the first part is blanked out, the computer sends a signal to the in-feed rolls to advance the feed stock in increments suitable for the automatic blanking. Air lines 70 are located on the press to laterally blow out slugs as well as the blanked out parts. As the parts are punched out, the feed stock now becomes scrap stock and is directed between a set of out-feed rolls consisting of a driven roll 72 which preferably has a knurled steel surface and a clamping idler roll 74 which is movable by pneumatic cylinders 76. A d.c. servo motor 78 drives the out-feed roll and also drives an encoder 80 to signal movement of the driven roll. Once the scrap stock enters the out-feed rolls, the feeding of the punch press is switched from the in-feed where the idler roll is raised out of contact and the out-feed rolls take over. The out-feed rolls continue the incremental feeding until the end of the feed stock strip is reached at which time the press flywheel stops operation while a new cycle starts with another strip picked up by the pick-up head, the feed stock advanced to the blanked out position, and the process is repeated. As the scrap stock leaves the out-feed rolls it passes through a guillotine-type chopper 82. That chopper is actuated by pneumatic cylinder 84 and is timed to activate each time the feed stock is halted for the punch cycle. The chopped up scrap stock is then collected in a container 86.

During the processing of the parts, an oiler (not shown) lubricates the feed stock just ahead of the punch press. Just ahead of the out-feed rolls is a knurled steel indexing roll 88 which is swung into position in forced contact with the scrap stock with a pneumatic cylinder 90. Movement of the indexing roll drives a shaft encoder 92 which provides an actual strip movement signal to the control unit. This movement is compared with out-feed roll movement as shown by encoder 80 to be certain the scrap stock is not slipping as it passes through the out-feed rolls. If the stock is slipping, the unit is automatically shut down until the situation is corrected.

Figure 3:
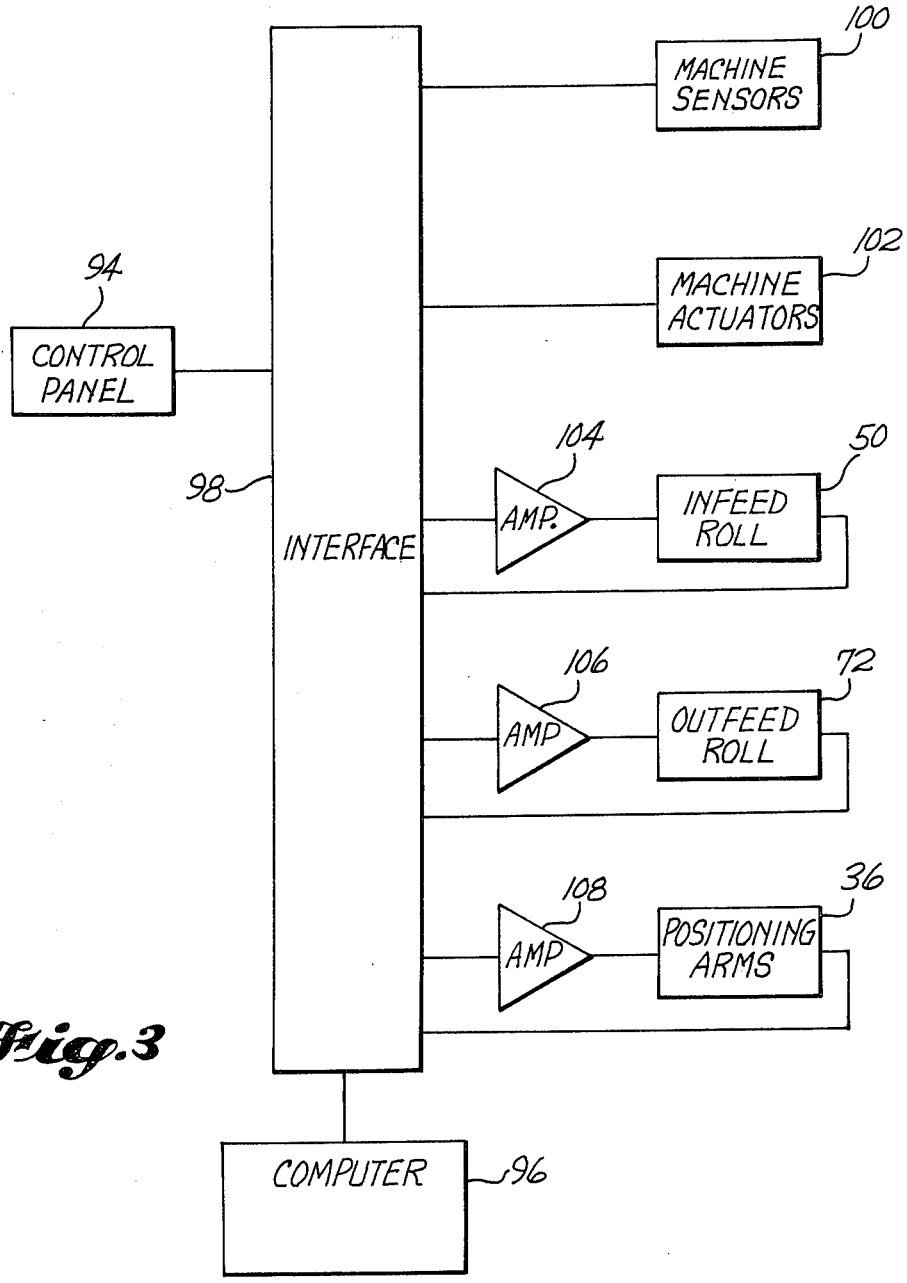
FIG. 3 shows a block diagram of the controls for this invention.

The control unit 24, as best shown in FIG. 3, consists of a control panel 94, a computer 96, and an interface 98. The operator inputs his commands to switches on the control panel. The commands are passed through the interface directly to the computer which in turn sends signals through the interface to the appropriate parts of the machine. Machine sensors 100 communicate to the computer items such as position of machine actuators, position of the crank shaft and error conditions. The machine actuators 102 are the type of devices that have only two positions. They are activated by the computer through the interface. On the other hand, the three servo systems of the in-feed rolls, out-feed rolls and the positioning arms are closed loop through the computer so that the computer determines where one of those units should be compared to actual position and if there is an error sends a correction signal to the servo unit. The amplifiers 104 for the in-feed roll, 106 for the out-feed roll and 108 for the positioning arms accept low level signals from the computer through the interface and amplify the signal to drive the appropriate servo motors.

In operation, a stack of strips of feed stock 34 is placed on the table 12. Signals are punched into the control panel setting forth the width of stock, the length between the calibration line and the blanking position, the incremental length of feed stock between blanking positions and the number of blanked parts required. The table rises to a position where the pick-up head 14 can reach the top strip feed stock 34. The positioning arms move to the width set to properly align the stock. The back-up arms 38 press the stack against the positioning arms. The pick-up head 14 picks up the leading edge of the top strip of feed stock and inserts it in the in-feed rolls 16. The idler roll 52 moves down to press the feed stock against driven feed roll 50 and the stock is fed into the press. As the end of the feed stock interrupts the light from light source 66, it establishes the calibration point and determines the additional travel of the feed stock to get into blanking position. The calibration point also establishes the reference point for the incremental advance of the feed stock during blanking. The feed stock which becomes scrap stock after the blanking takes place is pushed into the out-feed rolls 20. Once the scrap stock or skeleton reaches those rolls, the idler roll 74 moves down pressing the stock against the out-feed drive roll 72 and these rolls take over the feeding of the press. At the same time idler roll 52 moves away from driven in-feed roll 50 and indexing roll 88 moves against the scrap stock to measure slippage. The scrap stock is then advanced into the chopper 82.

We claim:

1. An apparatus for controlling a stack of strips of feed stock through a punch press comprising: a table having an adjustable height, adjustable positioning arms along the table to define an edge and to align a stock of strips of feed stock, adjustable back-stop arms located to hold the feed stock against the positioning arms to align the stock with a punch press, a set of in-feed rolls, a set of out-feed rolls, means for inserting the leading edge of the top strip of the feed stock into the in-feed rolls, means for locating the leading edge of the feed stock in a position for calibration with respect to the punch press, an encoder on one of the in-feed rolls to signal movement of the feed stock through the rolls to control the feed rolls based on in-feed roll movement to permit incrementally advancing the feed stock to punch out blanked parts, means for switching to out-feed rolls control of the feed stock once blanked out scrap stock enters the out-feed rolls, an encoder on one of the out-feed rolls to signal movement of the scrap stock through the out-feed rolls, means for controlling the out-feed rolls based on the out-feed roll movement, and a scrap stock indexing roll ahead of the out-feed rolls with the indexing roll driving a shaft encoder to signal actual scrap stock movement and shut down the movement of feed stock if the out-feed rolls turn and the scrap stock does not move accordingly.

2. An apparatus for controlling a stack of strips of feed stock as in claim 1 further comprising a chopper downstream from the out-feed rolls, having means for chopping the scrap stock each time the feed stock is stopped for punch-out by the punch press.

3. An apparatus for controlling a stack of strips of feed stock as in claim 1 further comprising compressed air means located to laterally eject blanked parts and to eject slugs out of the press.

4. An apparatus for automatically controlling a stock of strips of feed stock for a punch press comprising: a scissors-like table; positioning arms on the table located to position strips of feed stock to align with dies of a punch press; means for automatically positioning the arms to the width of the feed stock; back-stop arms adjustable located to keep the strips against the positioning arms; a set of in-feed rolls; a pickup head located above a leading edge of the strip stock and having a vertically mounted cylinder to move vacuum cups against the strip stock; vacuum means to actuate the vacuum cups to pick up the end of the strip, and a horizontally located cylinder to move the head and insert the raised end of the strip into the in-feed rolls; a light source located adjacent to the in-feed rolls and above the feed stock acts in conjunction with a photo-detector located below the feed stock to calibrate the position of the leading edge of the feed stock to the blanking die; an in-feed roll encoder to signal movement of the roll; means by use of the in-feed rolls for advancing the feed stock from the calibration position to the blanking position in the dies and for incrementally advacing the feed sstock thereafter; means for laterally removing blanked parts and slugs out of the press; an indexing roll contacting the scrap stock as it leaves the press; a set of out-feed rolls downstream from the indexing roll with the out-feed rolls having an encoder to signal movement of the rolls; means for switching to incrementally advancing of the feed stock by the out-feed rolls once the scrap stock enters the out-feed rolls; means for shutting down the line if the driving out-feed rolls rotate but the scrap stock does not move as indicated by the indexing roll, and means for chopping up the scrap stock after it leaves the out-feed rolls.

5. A method of handling feed stock through a punch press with steps comprising: aligning feed stock for passing through the dies of a punch press, establishing a reference line for the leading edge of the feed stock with respect to load position in the punch press, utilizing in-feed rolls for advancing the feed stock on the reference line, then to the punch position, stamping out a part, and incrementally advancing the feed stock through the punch press, laterally removing punched parts from the punched stock, switching to out-feed rolls for incrementally feeding the stock through the punch press once the scrap stock advances to the out-feed rolls, and removing the punched scrap stock.

6. A method of handling feed stock through a punch press as in claim 5, with steps further comprising: monitoring scrap stock movement through the out-feed rolls, and automatically shutting down the feed system when the scrap stock slips going through those rolls.

7. A method of handling feed stock through a punch press, with steps comprising: utilizing a variable height table, locating positioning arms on the table for aligning feed stock to a punch press, inserting the aligned feed stock into in-feed rolls, advancing the feed stock with the in-feed rolls, automatically stopping the in-feed with the leading edge of the feed stock aligned with a calibration position, referencing the feed roll for advancing the stock from the calibration position to an initial punch-out position in the press, advancing the feed stock in increments for punching, punching parts out of the feed stock, advancing the feed stock to out-feed rolls, and switching to feeding with the out-feed rolls once the blanked out scrap stock reaches the out-feed rolls, and removing the punched out scrap stock.

8. A method of handling feed stock through a punch press as in claim 7 with further steps comprising determining slippage between the out-feed roll and the scrap stock, and automatically shutting down the feed system if slippage is found.

9. A method of automatically feeding stacked feed stock through a punch press, with steps comprising: utilizing an adjustable height table, defining an edge of a stack of feed stock strips by advancing positioning arms from one side of the table, pressing the stack against the positioning arms by advancing diametrically located back-stop arms, picking up the top strip of feed stock adjacent a leading edge and advancing the strip into in-feed rolls by utilizing a vacuum in a pickup head, automatically raising the table as the strip is removed, advancing the leading edge of the strip to a calibration position, advancing the strip with the in-feed rolls into position for blanking, blanking out a part from the feed stock, advancing the feed stock in increments for blanking, laterally blowing blanked parts and punched out slugs away from the press, advancing the blanked out and now scrap stock into out-feed rolls, switching feeding of the stock to the out-feed rolls by pulling on the scrap stock, chopping up the scrap stock, picking up and feeding the next strip into the feed rolls when the last blank has been punched from the strip ahead, and automatically shutting down the feed if the scrap stock slips in respect to the out-feed rolls.

10. An apparatus for controlling feed stock through a punch press comprising: means for aligning feed stock to a punch press, electronic eye sensor means for establishing a reference line to a leading edge of the feed stock with respect to the punch press, a set of in-feed rolls having encoders signalling roll movement and computer operated controls for advancing the feed stock from the reference line into stamping position and for incrementally advancing the feed stock through the punch press, means for actuating the punch press to stamp out parts, means for removing the scrap stock, out-feed rolls having encoders signalling roll movement, and means for switching to impart incremented advance of the feed stock by the out-feed rolls.

11. An apparatus for controlling feed stock through a punch press as in claim 10 further comprising: a scrap stock indexing roll ahead of the out-feed roll having an encoder to sigal actual scrap stock movement and shut down the movement of feed stock if the out-feed rolls turn and the scrap stock does not move accordingly.

* * * * *